US009539588B2

(12) United States Patent
Le Guyader et al.

(10) Patent No.: US 9,539,588 B2
(45) Date of Patent: Jan. 10, 2017

(54) LABORATORY CENTRIFUGE WITH LOCKING SYSTEM FOR LOCKING IN TRANSLATION OF ROTOR ON DRIVING MOTOR SHAFT

(71) Applicant: AFI CENTRIFUGE, Chateau Gontier (FR)

(72) Inventors: Philippe Le Guyader, Poligne (FR); Jean-Claude Letourneur, Pornichet (FR); Norbert Rolland, Cholet (FR)

(73) Assignee: AFI CENTRIFUGE, Chateau-Gontier (FR)

( * ) Notice: Subject to any disclaimer, the term of this patent is extended or adjusted under 35 U.S.C. 154(b) by 308 days.

(21) Appl. No.: 14/265,601

(22) Filed: Apr. 30, 2014

(65) Prior Publication Data

US 2014/0329658 A1 Nov. 6, 2014

(30) Foreign Application Priority Data

May 2, 2013 (FR) ..... 13 54025

(51) Int. Cl.
*B04B 7/06* (2006.01)
*B04B 9/08* (2006.01)

(52) U.S. Cl.
CPC ..... *B04B 9/08* (2013.01); *B04B 2009/085* (2013.01)

(58) Field of Classification Search
CPC ..... B04B 9/08; B04B 2009/085; B04B 9/00
USPC 494/12, 16, 20, 33, 38, 64, 84, 85; 210/232
See application file for complete search history.

(56) References Cited

U.S. PATENT DOCUMENTS 2,329,499 A * 9/1943 Weaver ..... D01D 7/02 57/77
5,681,257 A * 10/1997 Letourneur ..... B04B 9/08 403/325
6,063,018 A * 5/2000 Letourneur ..... B04B 9/08 403/327
7,419,464 B2 * 9/2008 Matusima ..... B04B 9/08 403/322.2
7,837,607 B2 * 11/2010 Woodman ..... B04B 5/0421 494/12
8,678,987 B2 * 3/2014 Henne ..... B04B 9/08 494/12

(Continued)

FOREIGN PATENT DOCUMENTS

DE 43 26 231 A1 2/1995
EP 0 911 080 A1 4/1999

(Continued)

OTHER PUBLICATIONS

FR Search Report, dated Apr. 1, 2014, from corresponding FR application.

*Primary Examiner* — Charles Cooley
(74) *Attorney, Agent, or Firm* — Young & Thompson

(57) ABSTRACT

A laboratory centrifuge includes two rotating parts (10, 11) associated by translation locking elements (13) including at least one female element (16) and at least one complementary male element (15). The male element (15) is associated with elements (20) for its operation to the inactive position, which include a rotating actuator member (21) carried by one of the rotating parts (11) and which cooperates with the male element (15) to ensure, by a rotational operation of the rotating actuator member (21) about its axis of rotation (21'), the displacement of the associated male element (15) from the active position to the inactive position.

14 Claims, 7 Drawing Sheets

(56) References Cited

U.S. PATENT DOCUMENTS

| | | | | |
|---|---|---|---|---|
| 8,852,070 | B2 * | 10/2014 | Peters | B04B 9/08 494/12 |
| 9,079,195 | B2 * | 7/2015 | Todteberg | B04B 5/0414 |
| 9,149,815 | B2 * | 10/2015 | Kohn | B04B 5/0414 |
| 9,339,824 | B2 * | 5/2016 | Henne | B04B 9/08 |
| 9,452,436 | B2 * | 9/2016 | Ballhause | B04B 9/00 |
| 2011/0212819 | A1 * | 9/2011 | Kohn | B04B 5/0414 494/10 |
| 2011/0212822 | A1 * | 9/2011 | Henne | B04B 9/08 494/84 |
| 2013/0188894 | A1 * | 7/2013 | Peters | B04B 9/08 384/91 |
| 2013/0237399 | A1 * | 9/2013 | Letourneur | B04B 9/08 494/10 |
| 2013/0331253 | A1 * | 12/2013 | Ballhause | B04B 9/00 494/84 |
| 2014/0329658 | A1 * | 11/2014 | Le Guyader | B04B 9/08 494/82 |
| 2014/0349829 | A1 * | 11/2014 | Todteberg | B04B 5/0414 494/60 |
| 2015/0231648 | A1 * | 8/2015 | Henne | B04B 9/08 494/84 |
| 2016/0107171 | A1 * | 4/2016 | Bittner | B04B 9/08 494/84 |
| 2016/0158769 | A1 * | 6/2016 | Hornek | B04B 9/08 |

FOREIGN PATENT DOCUMENTS

| | | | | |
|---|---|---|---|---|
| FR | 2 951 964 | A1 | 5/2011 | |
| JP | 2006/159005 | A1 | 6/2006 | |
| WO | WO 8304379 | A1 * | 12/1983 | B04B 5/0414 |
| WO | 2007/134624 | A1 | 11/2007 | |
| WO | 2011/001729 | A1 * | 1/2011 | |

* cited by examiner

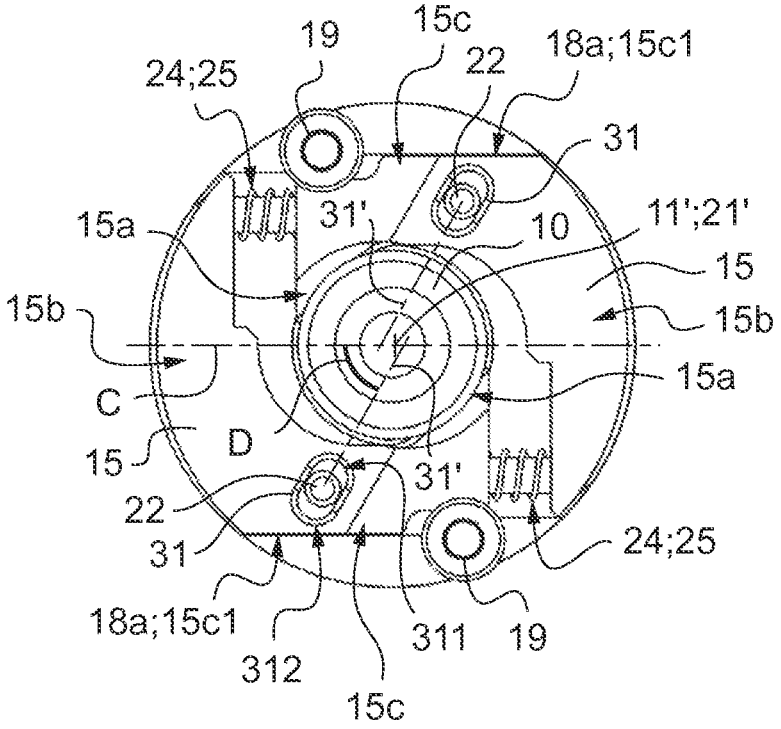
Fig.6
Fig.7
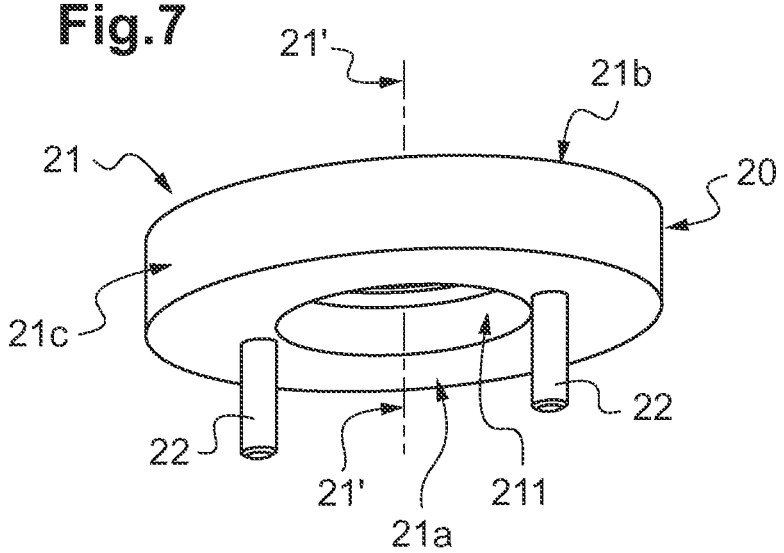

LABORATORY CENTRIFUGE WITH LOCKING SYSTEM FOR LOCKING IN TRANSLATION OF ROTOR ON DRIVING MOTOR SHAFT

TECHNICAL FIELD TO WHICH THE INVENTION RELATES

The present invention relates to the general field of the laboratory centrifuges, for separating the components contained in a liquid through a phenomenon of centrifugation.

TECHNOLOGICAL BACKGROUND

Centrifugation allows to separate components of very variable size and mass contained in a liquid sample, from molecules to entire cells.

Such centrifugation techniques are conventionally implemented by means of laboratory centrifuges that comprise a chamber containing two rotating parts, i.e.:

- a driving motor shaft, associated to motor means for the rotational operation thereof, and
- a rotor, intended to be mounted on said motor shaft and intended to receive the containers in which are provided the liquid samples to be centrifuged.

Conventionally, these two rotating parts are provided with complementary assembly means, for removably mounting the rotor on the free end of the driving motor shaft.

These assembly means comprise in particular means for locking in translation the two rotating parts associated to each other.

For example, in the document FR-2 951 964, these translation locking means comprise two male elements carried by the rotor, which are liable to occupy a position of cooperation with a female element arranged on the driving motor shaft.

These two male elements are each pivotally mounted about an axis of rotation extending parallel to a central longitudinal axis.

The rotor is mounted on the motor shaft by being simply fitted thereto, the male elements being retracted by being pushed by the rotor before being automatically locked in the active position within the above-mentioned female element.

To separate the rotor from the driving shaft, the operator must press simultaneously on two protruding lugs, diametrically opposed to each other, which are each carried by one of the pivoting male elements.

This action allows to operate the male elements to an inactive position, which corresponds to their separation from the female element, so as to make possible the translation of the rotor with respect to the driving motor shaft.

But, in practice, pressing on these lugs is not always easy and is not much ergonomic. It is indeed often necessary to exert a relatively high force to obtain the displacement of these lugs, and this with only the end of the fingers. Furthermore, the operation of these lugs requires a precise positioning of the fingers, which forces the operator to verify their orientation before manipulating them.

The operator must also displace entirely the two lugs; the differences of feeling when manipulating one and/or the other of these lugs might disturb the user, up to make him/her have doubts about the operation thereof between the locked and unlocked positions.

Such lugs are moreover liable to generate an aerodynamic noise; they are also relatively complex to clean, as the locking means are relatively open.

OBJECT OF THE INVENTION

Within this context, and to remedy the above-mentioned drawbacks, the applicant has developed a laboratory centrifuge whose structure allows a easy, simple, intuitive and ergonomic operation to the inactive position of the male element(s) of the translation locking means.

The laboratory centrifuge according to the invention is of the type comprising two rotating parts, the one being a driving motor shaft and the other being a rotor, which each have a central longitudinal axis and which are provided with complementary assembly means for removably mounting said rotor on a free end of said driving motor shaft, coaxially to each other; these assembly means comprise means for the locking in translation of said rotor on said driving motor shaft, which translation locking means comprise at least one female element equipping one of said rotating parts and at least one complementary male element equipping the other of said rotating parts, which male element is mobile between—an active position, in which it is able to cooperate with said female element to ensure said locking in translation, and—an inactive position, in which it is separated from said female element, to make possible the translation of said rotor with respect to said driving motor shaft, which male element is associated, on the one hand, with active-position return means, and on the other hand, to means for its operation to the inactive position.

And according to the invention, the inactive-position operating means comprise a rotating actuator member that is carried by one of said rotating parts and that is pivotally mobile about itself according to an axis of rotation extending coaxially to the central longitudinal axis of said associated rotating part; which rotating actuator member cooperates with said male element to ensure, by a rotational operation of said rotating actuator member about its axis of rotation, the displacement of said associated male element from said active position to said inactive position.

Such a rotating actuator member has thus the interest to allow a control of the translation locking means to their inactive position, and this in a particularly simple and fast manner, and without requiring a particular angular positioning of the operators fingers.

According to a preferred embodiment, the rotating actuator member of the operating means is carried by the rotor.

In this case, the rotating actuator member is preferably provided protruding at an upper end of said rotor, opposite an access to a bowl of the centrifuge intended to contain the rotating parts.

According to other advantageous characteristics, which can be taken independently or in combination:

- the male element is carried by the rotor and the female element is arranged on the driving motor shaft;
- the driving motor shaft is intended to be driven into rotation in a given direction of rotation, and the rotating actuator member is operated in said given direction of rotation for the displacement of said male element from its active position to its inactive position.

According to an interesting embodiment, the male element is mobile in translation for its operation between its active and inactive positions.

In this case, preferably, the rotating actuator member includes a protruding rod, extending parallel to and remote from the axis of rotation of said rotating actuator member, and the male element includes a housing within which extends said protruding rod, which housing is arranged so that, during the rotational operation of said rotating actuator member, said moving rod causes the translational displacement of said associated male element.

Still in this case, the male element is arranged inside a continuous tubular envelope that is provided with means for the fixation to the associated rotating part, which carries the rotating actuator member and which cooperates with said male element for its guiding in translation.

Also in this case, the translation locking means comprise two male elements that are arranged symmetrically with respect to the central longitudinal axis of the associated rotating part, and each male element includes an elongated cylindrical portion that is associated with an active-position return member and is inserted in a complementary housing arranged in the other male element, to form translation guiding means and active-position return means.

According to another feature, the male element advantageously comprises:

- a nesting portion intended to cooperate with the female element, arranged on one side of the central longitudinal axis, and
- a counterweight portion, arranged on the other side of said central longitudinal axis.

The centrifuge according to the invention preferably also comprises axial clearance compensation means, including a continuous ring which is slidingly mounted on the driving motor shaft and which is adapted to come in rest against a lower surface of the rotor mounted on said driving motor shaft, which continuous ring is associated with a spring member, pressing on said continuous ring, so as to tend to push said rotor back; and said driving motor shaft includes an O-ring intended to cooperate with the rotor to participate to the axial clearance compensation.

The present invention also relates to a rotor equipping a centrifuge as defined hereinabove, and carrying the rotating actuator member.

Still according to a preferred embodiment, the assembly means comprise two nestable members, i.e.—a mortise member, arranged on one of the rotating parts, and—a tenon member, carried by the other of the rotating parts.

The assembly means also comprise means for the rotational coupling between the nested complementary members.

To form these rotational coupling means, the rotating parts each advantageously include at least one coupling segment whose section perpendicular to its longitudinal axis is constant, non-circular and symmetrical about said longitudinal axis, so as to make possible a translational nesting of said rotor on said motor shaft according to a plurality of orientations.

Such a structure of the coupling means could possibly by implemented in combination with other translation locking means than those defined hereinabove, in accordance with the present invention.

This coupling structure is particularly interesting, allowing a plurality of angular orientations between the two rotating parts, in particular with respect to the coupling means described in the document FR-2 951 964 allowing only two angular positions with the assembly difficulties resulting therefrom.

Advantageous characteristics of these particular coupling means, which can be taken individually or in combination, are detailed hereinafter:

- the coupling segments consist in cylindrical surfaces provided with complementary teeth, advantageously straight teeth;
- the rotor include the mortise member, and the upper end of the driving motor shaft forms the tenon member;
- the mortise member includes an access opening for the insertion of the tenon member, and the coupling segment of said mortise member extends between said access opening and the male element;
- the translation locking housing consists in an annular groove arranged in the tenon member, and the coupling segment of said tenon member extends on either side of said annular groove; in this case, the height of the coupling segment of the mortise member is higher that the height of the annular groove forming the translation locking housing.

BRIEF DESCRIPTION OF THE DRAWINGS

The invention will be further illustrated, without being limited in anyway, by the following description of a particular embodiment, in relation with the appended drawings in which:

FIG. 6 is a partial top view of the rotor, showing the male elements belonging to the translation locking means and cooperating with the driving motor shaft;

FIG. 7 shows, in isolation and in perspective, the rotating actuator member for the operation of the male elements to the inactive position;

DETAILED DESCRIPTION OF THE PREFERRED EMBODIMENTS

Figure 1:
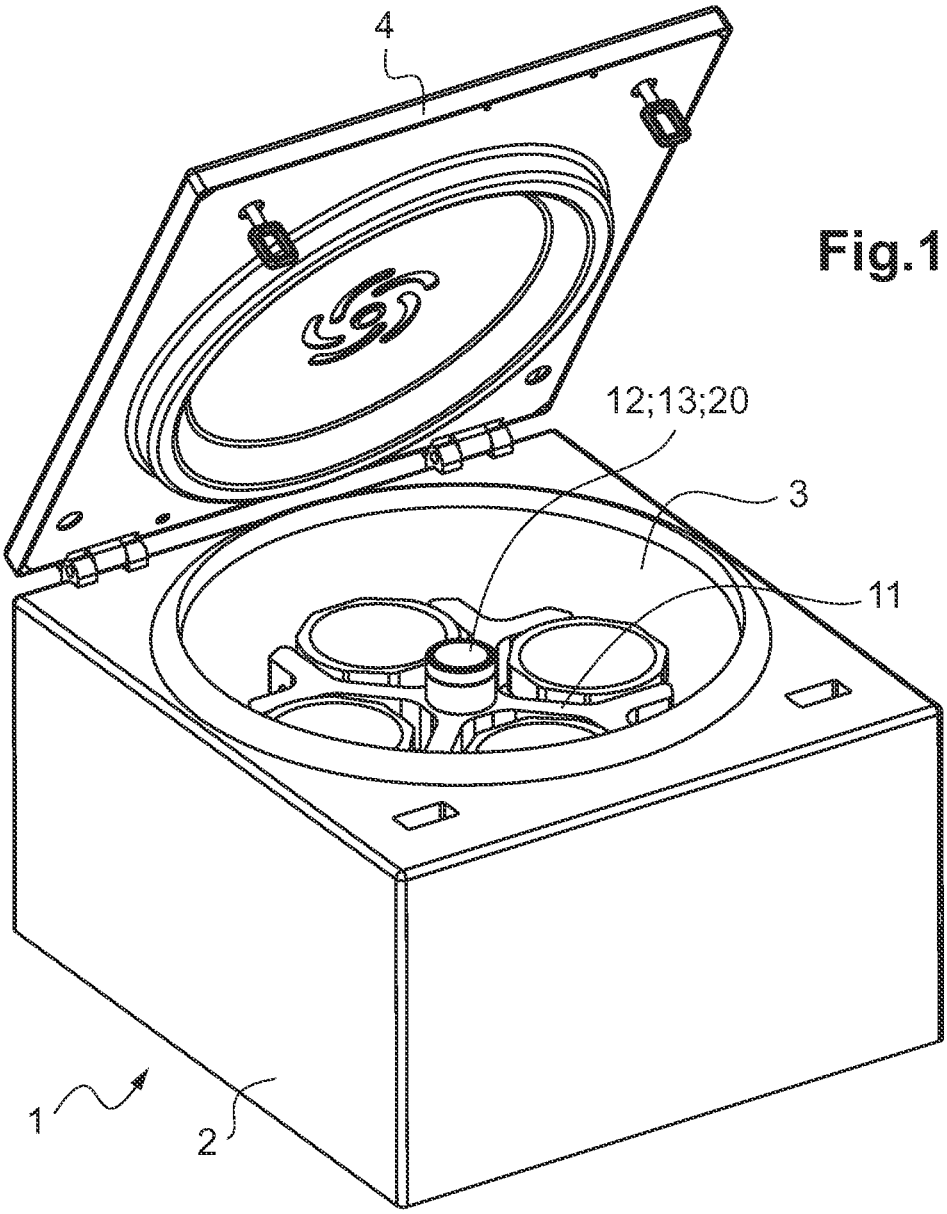
FIG. 1 is a general view of a laboratory centrifuge according to the invention, wherein the lid is shown in open position.

The laboratory centrifuge 1, as shown in a general and perspective view in FIG. 1, comprises a casing 2 that integrates a shielded bowl 3 and that carries a lid 4.

This lid 4 is pivotally mounted between—a closed position (not shown), to close the shielded bowl 3, and—an open position (FIG. 1) to clear the access to this bowl 3.

The shielded bowl 3 contains two rotating parts, which are shown in details in FIGS. 2 to 14, i.e.:

a driving motor shaft 10, rotationally operated by motor means (not shown) integrated in the casing 2, and a rotor 11, intended to be carried by the driving motor shaft 10.

The two rotating parts 10, 11 each have a central longitudinal axis 10', 11'.

In FIGS. 2 to 14, only the central portion of the rotor 11 is shown.

Conventionally, the rotor 11 is intended to carry containers (tubes, pockets, etc.) each receiving at least one liquid sample intended to undergo the centrifugation operations.

The rotor 11 is herein of the mobile buckets/cups rotor type (also called "swing out" or "sw rotor"). These mobile buckets, not shown in the figures, are each mounted free in rotation about an axis extending horizontally and perpendicular to the axis of rotation of the rotor 11.

As an alternative, the rotor 11 could be of the fixed-angle type, in which the containers are placed in hollow housings generally inclined between 15° and 45° relative to the vertical.

These two rotating parts 10 and 11 are provided with complementary assembly means 12 for the removable mounting of the rotor 11 on a free end of the driving motor shaft 10, coaxially relative to each other.

As developed hereinafter, these assembly means 12 comprise, on the one hand, means 13 for the locking in translation of the rotor 11 on the driving motor shaft 10, and on the other hand, means 14 for the coupling in rotation between these two rotating parts 10, 11 assembled together.

The translation locking means 13 and the coupling means 14 are arranged for one part on the rotor 11 and for another part on the driving motor shaft 10.

The translation locking means 13 comprise complementary elements, intended to cooperate with each other by nesting, i.e.:

two male elements 15 (FIGS. 4 and 6), which herein equip the rotor 11, and a female element 16 (visible in particular in FIG. 5), which is arranged on the driving motor shaft 10 and which is herein in the form of an annular groove.

Figure 2:
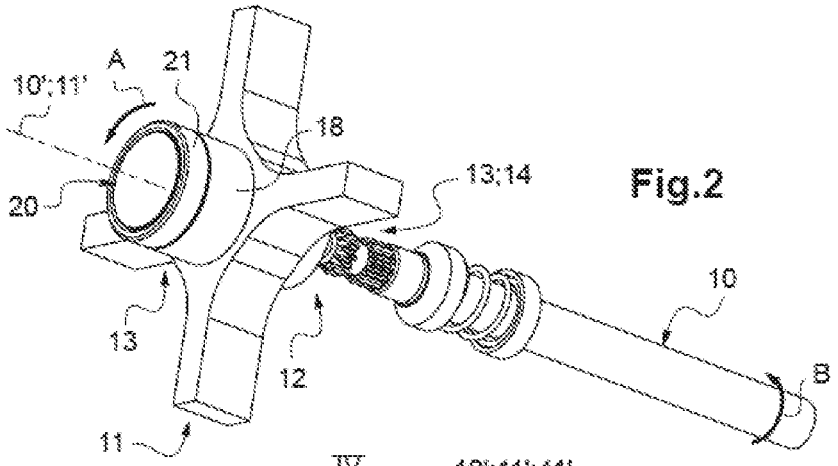
FIG. 2 is an isolated perspective view of the driving motor shaft and the rotor, which are dissociated from each other, equipping the laboratory centrifuge according to FIG. 1.
Figure 3:
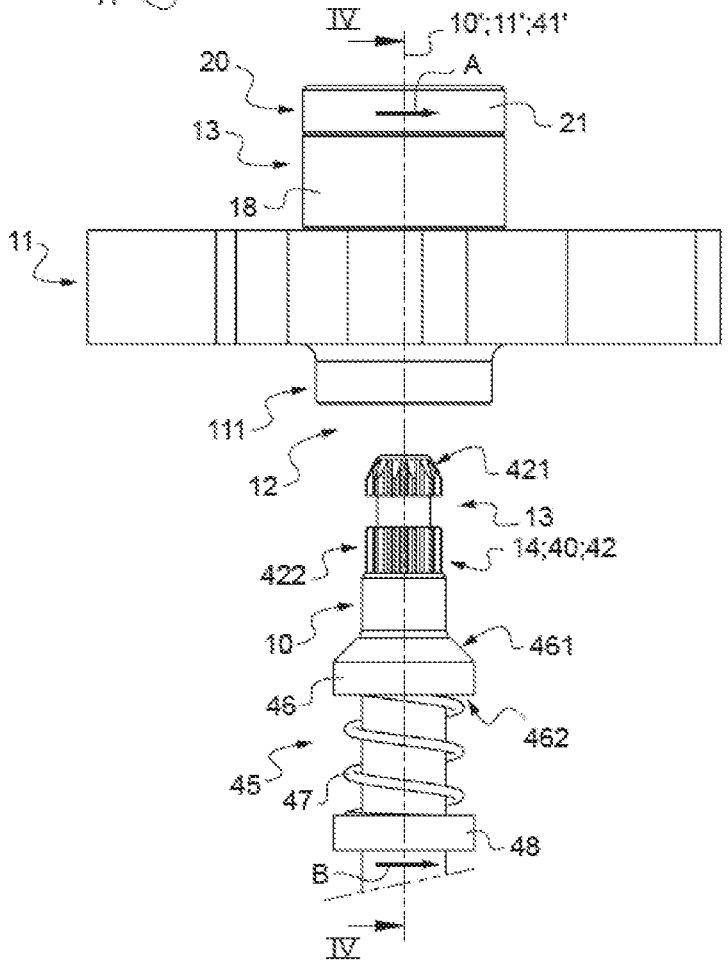
FIG. 3 is a side view of the two rotating parts according to FIG. 2.
Figure 4:
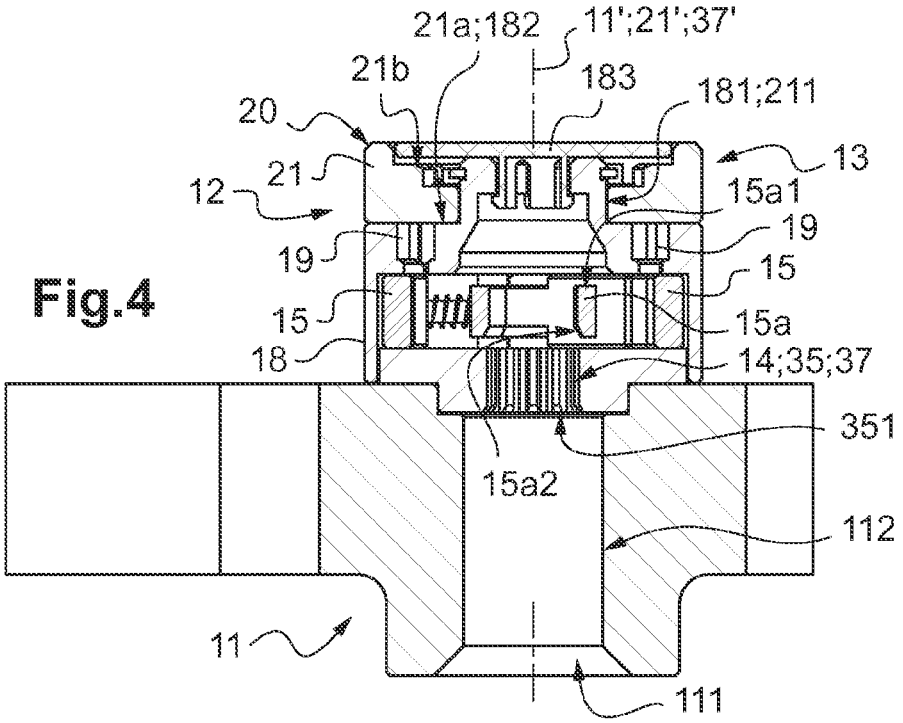
FIG. 4 is a cross-sectional view of the rotor of FIG. 3, according to an upper portion of cutting plane IV-IV passing through its central longitudinal axis.

The male elements 15 of the rotor 11 are herein arranged inside a continuous tubular envelope 18, visible in particular in FIGS. 2 to 4 (this continuous tubular envelope 18 is not illustrated in FIG. 6 only for the sake of direct visual access to the male elements 15).

As used herein, "continuous" means an envelope 18 devoid of any lateral opening, herein formed of a generally cylindrical wall.

This tubular envelope 18 is provided with means 19 for its removable fixation on the rotor 11.

These fixation means 19 consist for example in two screws added in two housings extending parallel to the central longitudinal axis 11' of the rotor 11.

These male elements 15 are mobile within the tubular envelope 18, between two end-of-travel positions:

an active position (FIGS. 4, 6 and 9), at rest, in which they are able to cooperate with the female element 16 of the motor shaft 10 to ensure the translation locking function, and an inactive position (FIGS. 13 and 14), in which they are able to be separated from the female element 16 to make possible the translation of the rotor 11 relative to the driving motor shaft 10.

The male elements 15 cooperate with means 20 for their operation to the inactive position, as shown in isolation in FIG. 7.

These operating means 20 comprise in particular a rotating actuator member 21, whose rotational displacement by an operator causes the displacement of the male elements 15 from the active position to the above-mentioned inactive position.

This rotating actuator member 21 is herein pivotally mobile about itself, according the its longitudinal axis 21' that extends coaxially to the central longitudinal axis 11' of the associated rotor 11.

The rotating actuator member 21 herein consists in a cylindrical part, generally ring shaped, provided with a cylindrical central housing 211 (FIG. 7).

This rotating actuator member 21 includes two opposite circular surfaces, extending perpendicular to the longitudinal axis 21', i.e.—a lower surface 21*a*, located on the side of the rotor 11, and—a free, upper surface 21*b*, opposite to the rotor 11.

These two surfaces 21*a*, 21*b* are connected to each other by a cylindrical peripheral surface 21*c*.

This cylindrical peripheral surface 21*c* is advantageously provided with a non-skid coating intended to serve as a gripping surface for an operator during the rotational operation of the rotating actuator member 21.

In this case, this rotating actuator member 21 is carried by the tubular envelope 18, with a rotational degree of freedom about its longitudinal axis 21'.

For example, the central housing 212 of this rotating actuator member 21 is fitted on a cylindrical extension 181 of the envelope 18 and its lower surface 21*a* rests on a shoulder 182 of the envelope 18. A locking part 183 forming a cap is added on the envelope 18, opposite the upper surface 21*b* of the rotating actuator member 21, for its locking in position.

This rotating actuator member 21 is protruding at the upper end of the rotor 11 and of the tubular envelope 18 (FIGS. 2 to 4); it is hence intended to come in position opposite the opening for access to the bowl 3, to facilitate the operation thereof by an operator when the lid 4 is in the open position (FIG. 1).

For the displacement of the male elements 15 toward the inactive position, this rotating actuator member 21 is intended to be operated in a given direction of rotation A, herein the anti-clockwise direction, as illustrated by the arrow A shown in FIGS. 2 and 3.

This direction of rotation A applied to the rotating actuator member 21, for the inactivation of the male elements 15, is advantageously the same as the direction of rotation B of the driving motor shaft 10 and of its rotor 11 within the framework of the centrifugation operations.

This identity of the directions of rotation A and B aims to prevent any risk of operation of the rotating actuator member 21 produced by a phenomenon of friction with the air, liable to occur at a high speed of rotation of the rotor 11.

It is hence tried to avoid any accidental displacement of the male elements 15 toward their inactive position.

This particularity also allows to benefit from the force of friction with the air to participate to the holding of the male elements 15 in the end-of-travel position, and hence to participate to the holding of these male elements 15 in their active position.

The rotational operation of the rotating actuator member 21 is herein transformed into a translational movement of the two male elements 15 between their inactive and active positions.

For that purpose, at its lower surface 21*a*, the rotating actuator member 21 includes two protruding rods 22 (FIG.

7), intended to each cooperate with one of the two male elements 15 for the wanted displacement to the inactive position.

For that purpose, the two protruding rods 22 each extend parallel to, and at as same distance from, the longitudinal axis 21' of the rotating actuator member 21.

These protruding rods 22 are hence intended to underdo an offset movement of rotation about the longitudinal axis 21' during the rotation of the rotating actuator member 21, to each ensure the displacement of one of the male elements 15.

The structure of these male elements 15 is described in more details hereinafter in relation with FIGS. 6 and 12.

The two male elements 15, cooperating with the rotating actuator member 21, each have herein a generally U-shape that consists of three portions:

- a nesting portion 15*a*, intended to cooperate with the annular groove 16 of the driving motor shaft 10, arranged on one side of the central longitudinal axis 11' of the rotor 11,
- a counter-weight portion 15*b*, arranged on the other side of said central longitudinal axis 11' of the rotor 11, and
- a junction portion 15*c*, extending between said nesting portion 15*a* and said counter-weight portion 15*b*.

As shown in particular in FIG. 4, the nesting portion 15*a* of each male element 15 includes—an upper edge 15*a*1, to ensure the translation locking with the female element 16, and—a lower edge 15*a*2, forming a ramp useful for its retraction during the positioning of the rotor 11 on the motor shaft 10.

The two male elements 15 are arranged symmetrically relative to each other, taking into account the central longitudinal axis 11' of the associated rotor 11.

These two male elements 15 are imbricated one into the other, with the nesting portion 15*a* of one of said male elements 15 extending between the nesting 15*a* and counter-weight 15*b* portions of the other of said male elements 15.

The male elements 15 are herein mobile in translation for their operation between the inactive and active positions.

The direction of translation of these two male elements 15 is illustrated by the axis of translation C shown in FIG. 6, i.e. a direction extending perpendicular to the central longitudinal axis 11' of the rotor 11 and to the axis of rotation 21' of the rotating actuator member 21.

For that purpose, these male elements 15 herein cooperate with each other through translation guiding means 24, associated with active-position return means 25.

The translation guiding means 24 include two elongate cylindrical rods 26 (FIG. 12) that are each carried by the free end of the counter-weight portion 15*b* of one of the male elements 15, parallel to the direction of translation C.

Each elongated cylindrical rod 26 is inserted within a compression spring member 25, herein forming the active-position return means for the male elements 15.

Figure 12:
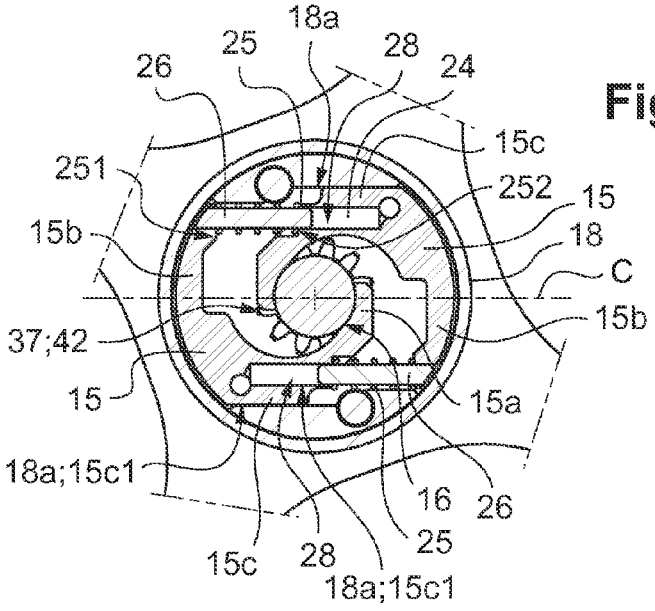
FIG. 12 is a cross-sectional view of FIG. 11, according to a cutting plane XII-XII passing through the male elements of the translation locking means and extending perpendicular to the above-mentioned central longitudinal axes.
Figure 13:
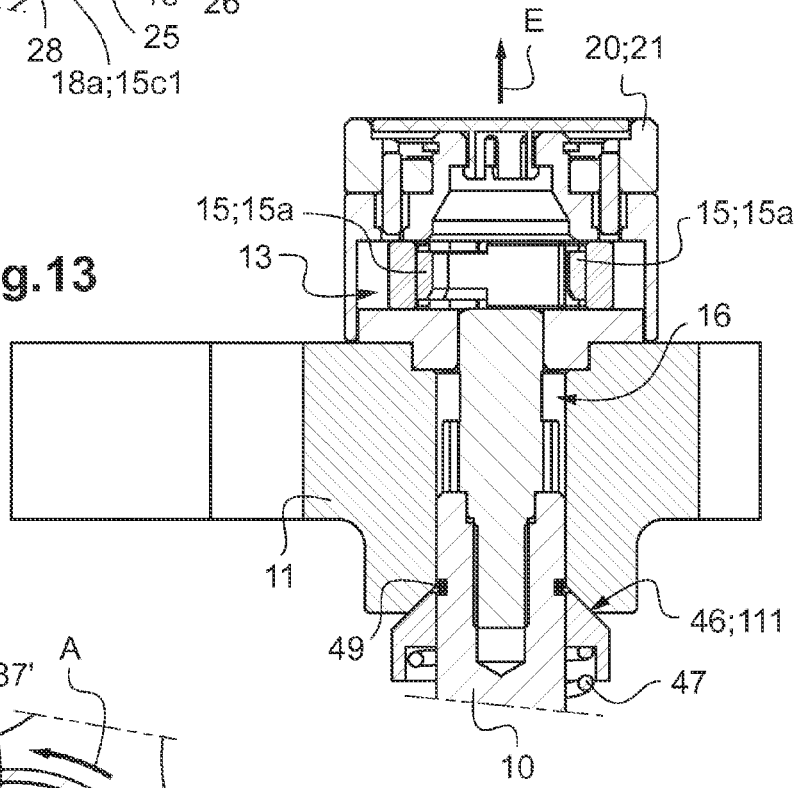
FIGS. 13 and 14 correspond to FIGS. 11 and 12, respectively, in which the rotating actuator member is pivotally operated so as to ensure the displacement of the male elements to the inactive position.

This elongated cylindrical rod 26 is inserted with a translational degree of freedom into a complementary housing 28 arranged in the junction portion 15*c* of the opposite male element 15 (FIG. 12).

This complementary housing 28 extends also parallel to the direction of translation C, so as to make possible a translation of the associated elongated cylindrical rod 26 over its length, and to define together the direction of translation C.

This spring member 25 is interposed between two opposite surfaces, the one 251 on the counter-weight portion 15*b* of a male element 15 and the other 252 on the junction portion 15*c* of the opposite male element 15.

The guiding in translation of the two male elements is also optimized by the continuous tubular envelope 18 that includes two inner, planar guiding surfaces 18*a*, extending parallel and opposite to each other, and parallel to the direction of guiding C.

Each of these guiding surfaces 18*a* serves as a support for a complementary planar surface 15*c*1 of the junction portion 15*c* of one of the male elements 15.

Each male element 15 also includes a housing 31 within which extends the end of one of the above-mentioned protruding rods 22 of the rotating actuator member 21 (FIG. 6).

These housings 31 are arranged so that, during the rotational operation of the rotating actuator member 21, the offset rotational displacement of each rod 22 causes the translational displacement of the associated male element 15, along the guiding direction C.

In this respect, each of these housings 31 consists in an elongated notch, herein oblong in shape, opening towards the inner face 21*a* of the rotating actuator member 21 and with a through-axis that is parallel to the central longitudinal axis 11'. This housing 31 includes a symmetry axis 31' oriented in the direction of its great length.

Each of these housings 31 has herein—a width corresponding, to within the clearance, to the section of the associated rod 22 and—a length higher than this section, to allow the travel thereof over its length.

These housings 31 each include two ends, i.e.—a proximal end 311, located on the side of the central longitudinal axis 11' of the rotor 11, and—a distal end 312, located remote from this same central longitudinal axis 11'.

These housings 31 are inclined with—the proximal end 311 on the side of the nesting portion 15*a* and—the distal end 312 on the side of the counter-weight portion 15*b*.

The longitudinal axis 31' of each of these housings 31 hence defines an acute angle D with the direction of translation C.

In this case, this angle D is advantageously comprised between 15° and 90° with respect to the translation direction C.

As shown in FIG. 4, these two male elements 15 are arranged within a blind cylindrical housing 35 of the rotor 11, which is intended to receive, by nesting, a free end segment of the driving motor shaft 10.

The nesting portions 15*a* of the male elements 15 extend on either side of this blind housing 35, in a diametrically opposed manner (in particular, FIGS. 4 and 12). This blind housing 35, forming a so-called "mortise" member, includes, over a portion of its length, a coupling segment 37 belonging to the above-mentioned rotational coupling means 14.

This coupling segment 37 extends along a longitudinal axis 37' that is coaxial with respect to the central longitudinal axis 11' of the rotor 11.

For the rotational coupling, the coupling segment 37 has a section, perpendicular to its longitudinal axis 37', that is constant, non circular and symmetrical about said longitudinal axis 37'.

As used herein, a "constant" section means a section that is identical in different successive planes perpendicular to the longitudinal axis 37'.

In particular, this coupling segment 37 herein consists of a cylindrical surface provided with straight teeth.

As an alternative, which is not shown, this coupling segment 37 could also consist in a polyhedral surface, with a convex polygonal section, for example in the general shape of a cube or a parallelepiped.

The coupling segment 37 herein extends between, on the one hand, an opening 351 for access to the blind housing 35 and, on the other hand, the male elements 15 for the locking in translation (FIG. 4).

Figure 5:
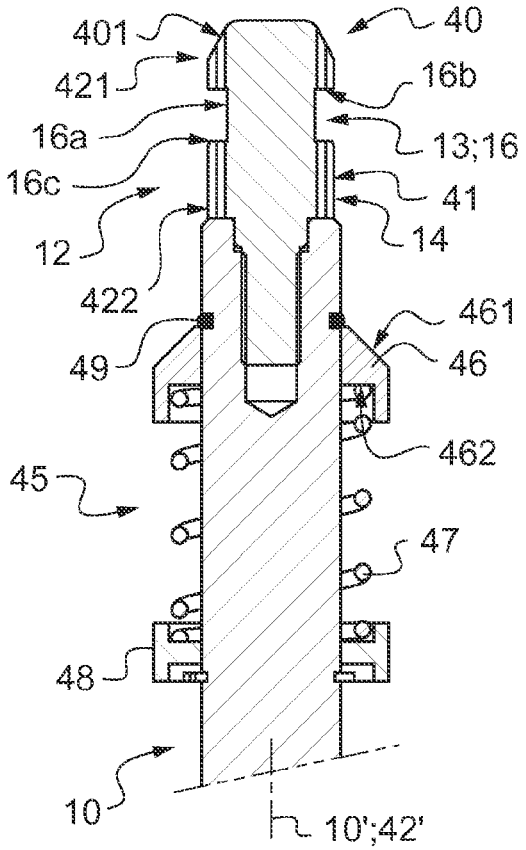
FIG. 5 is a cross-sectional view of the driving motor shaft of FIG. 3, according to a lower portion of cutting plane IV-IV passing through its central longitudinal axis.

This blind housing 35 is intended to be fitted on the free end portion 40 of the driving motor shaft 10 (FIG. 5).

This free end portion 40, forming a so-called "tenon" member, complementary of the blind housing 35 of the rotor 11, is provided with—the female element 16 of the translation locking means 13 and—a portion complementary of the rotational coupling means 14 (FIGS. 3 and 5).

This free end portion 40 is provided with a bevelled upper end 401, of generally truncated shape, to participate to the retraction of the male elements 15 during the mounting of the rotor 11 on the motor shaft 10.

The female element 16, arranged on this free end portion 40, is herein in the form of a simple annular groove.

This female element 16 is delimited by a cylindrical surface 16*a* ended by an upper crown 16*b* and by a lower crown 16*c*.

The height of this female element 16 (corresponding to the distance separating the two opposite crows 16*b* and 16*c*) is advantageously equal, to within the clearance, to the height of the nesting portions 15*a* of the male elements 15, for the reception of these latter in the active position during the locking in translation.

On either side of this female element 16, the free end portion 40 includes a coupling segment 42 belonging to the above-mentioned rotational coupling means 14.

These coupling segments 42 extend along a longitudinal axis 42' that is coaxial relative to the central longitudinal axis 10' of the motor shaft 10.

For the rotational coupling of the two rotating parts 10 and 11, the coupling segments 42 have a section complementary to that of the coupling segment 37 of the rotor 11, i.e. here again a section, perpendicular to its longitudinal axis 42', constant, not circular and symmetrical about said longitudinal axis 42'.

In particular, the coupling segments 42 herein consist of a cylindrical surface provided with straight teeth.

As an alternative, which is not shown, the coupling segments 42 could also consist in a polyhedral surface, with a convex polygonal section, for example in the general shape of a cube or a parallelepiped, to cooperate with a coupling segment of complementary shape arranged on the rotor 11.

The two coupling segments 42 are separated from each other by the above-mentioned female element 16, to form:

- an upper segment 421, above the female element 16 and on the side of the free end of the motor shaft 10, and
- a lower segment 422, under the female element 16 and remote from the free end of the motor shaft 10.

Within this framework, the height of the coupling segment 37 of the mortise member 35 of the rotor 11 is higher than the height of the annular groove 16 of the motor shaft 10.

This structural feature allows a rotational coupling all along the nesting operation of the rotor 11 on the motor shaft 10.

Indeed, the coupling segment 37 of the rotor 11 hence permanently cooperates with one and/or the other of the coupling segments 421, 422 of the motor shaft 10, during the translational travel through the female element 16.

Generally, this particular structure of the rotational coupling means 14 could be implemented on a rotor/motor shaft unit of a laboratory centrifuge that would include translation locking means different from those described above.

Besides, the motor shaft 10 also includes means 45 for the compensation of the axial clearances of the added rotor 11 (FIGS. 3 and 5).

These clearance compensation means 45 include a continuous ring 46 that is slidingly mounted over a part of the length of the driving motor shaft 10.

This ring 46 includes two opposite surfaces, i.e.:

- a frustum upper surface 461, oriented towards the free end 401 of the motor shaft 10, that is adapted to come in rest against an also frustum lower surface 111 of said rotor 11, and
- a lower surface 462, oriented at the opposite, resting on a spring member 47 pressing on said continuous ring 46 so as to tend to push the latter back towards the free end of the motor shaft 10.

The other end of the spring member 47 is in rest on a fixed lower flange 48. These axial clearance compensation means 45 also include an O-ring 49 that is intended to cooperate, in compression, with a cylindrical inner surface 112 of the rotor 11 (FIG. 4).

This O-ring 49 also serves herein as a top end-of-travel stop for the continuous ring 46.

The assembly of the rotor 11 to the motor shaft 10 is described hereinafter in relation with FIGS. 3 and 8 to 12.

Firstly, the rotor 11 is arranged coaxially with respect to the motor shaft 10 (FIG. 3).

The male elements 15 of this rotor 11 are in the active position, under the effect of return means 25.

The nesting portion 15*a* of these male elements 15 then extends within the space of the blind housing 35, which is defined laterally by its coupling segment 37.

Figure 8:
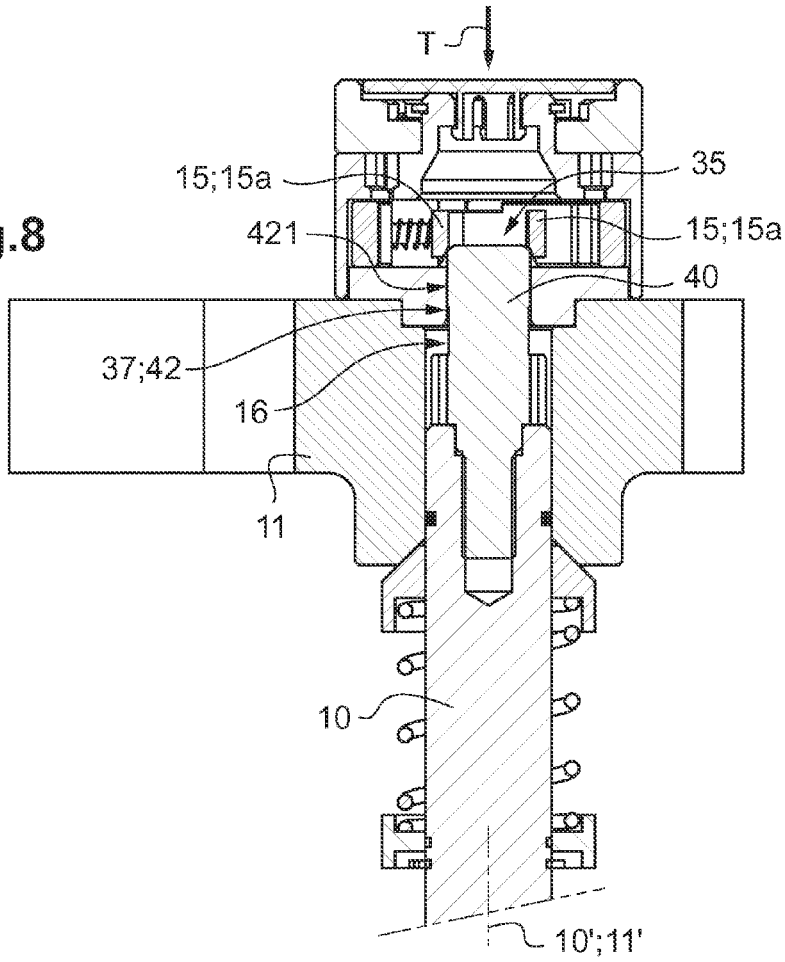
FIGS. 8 and 9 illustrate two successive steps of the kinematics of positioning of the rotor on the free end of the driving motor shaft.
Figure 9:
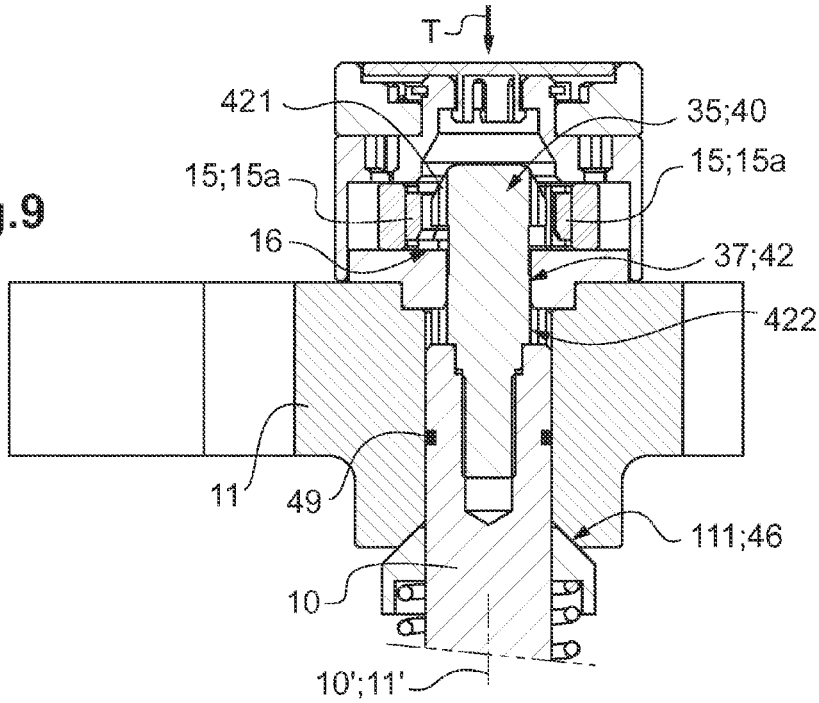

This rotor 11 is then operated in translation downward and according to a direction coaxial to its central longitudinal axis 11', as illustrated by the arrow T in FIGS. 8 and 9.

When the tenon member 40 of the motor shaft 10 reaches the access opening 351 of the mortise member 35 of the rotor 11, the latter is possibly operated slightly in rotation with respect to the motor shaft 10, so as to match their respective coupling segments 37, 42.

These complementary coupling segments 37, 42 are herein adapted to allow a plurality of angular orientations of the rotor 11 on the motor shaft 10, which facilitates the angular positioning of the rotor 11 on this motor shaft 10 for the assembly thereof.

Once the rotor 11 suitably oriented, the operator has just to continue the translational displacement of the rotor 11 on the motor shaft 10 along the above-mentioned translation direction T.

The coupling segment 37 of the rotor 11 thus travels along the coupling segments 42 of the motor shaft 10, i.e. successively along the upper segment 421 (FIG. 8), the female element 16 and the lower segment 422 (FIG. 9).

During this operation, the male elements 15 of the rotor 11 are pushed back, in the inactive position, by the truncated free end 401 of the motor shaft 10 and in particular by the upper coupling segment 421 (FIG. 9).

Figure 11:
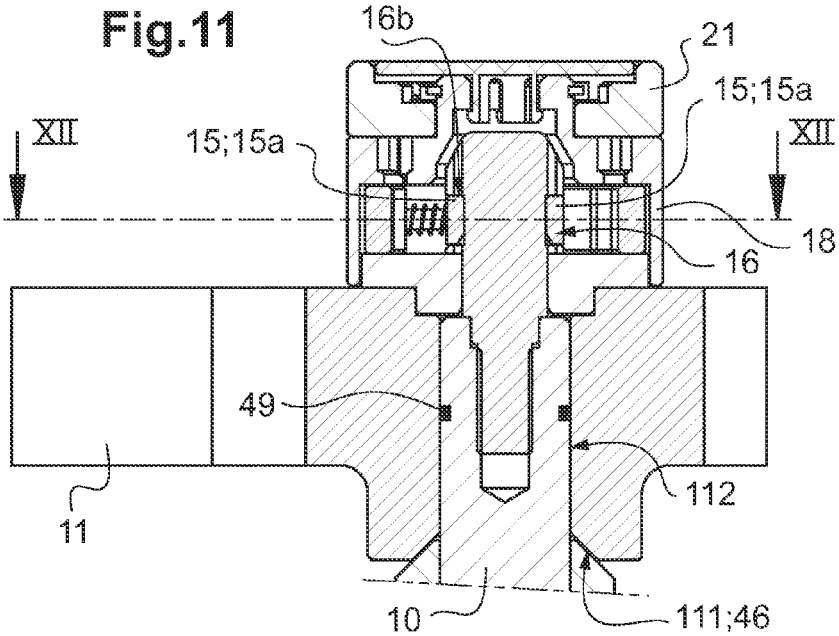
FIG. 11 is a cross-sectional view of FIG. 10, according to a cutting plane XI-XI passing through the central longitudinal axes of the rotor and of the driving motor shaft, arranged coaxially relative to each other.

These male elements 15 of the rotor 11 automatically come back to the active position, under the effect of the active-position return means 25, when they arrive opposite the female element 16 of the motor shaft 10 (FIGS. 11 and 12).

These male elements 15 come in particular in rest against the upper crown 16*b* of the female element 16, to constitute the extraction stop of the rotor 11 with respect to the motor shaft 10.

The rotor 11 is hence locked in translation and in rotation with respect to the driving motor shaft 10, in an automatic manner, by a simple translational operation of the rotor 11 on the motor shaft 10.

During this mounting, the lower edge 111 of the rotor 11 comes in rest on the continuous ring 46, and causes its displacement downwards, associated with a putting in compression of the spring member 47.

The axial clearances of the rotor 11 added on the motor shaft 10 are then compensated by the above-mentioned compensation means 45, with in particular—the ring 46 pushed back against the lower surface 111 of said rotor 11, by the compression spring member 47, and—the O-ring 49 compressed by the cylindrical inner surface 112 of the rotor 11.

A centrifugation cycle can then be implemented, by a putting into rotation of the motor shaft 10/rotor 11 unit.

When the rotor 11 is stopped, after the opening of the lid 4, the operator can detach this rotor 11 with respect to the motor shaft 10.

Figure 14:
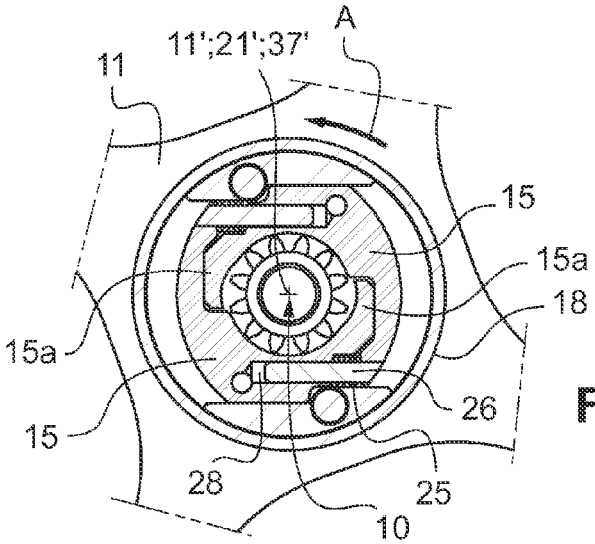

For that purpose, the operator has just to operate in rotation the rotating actuator member 21, in the above-mentioned direction A (FIG. 14).

The operator can grip the rotating actuator member 21, whatever the angular orientation of the rotor 11.

During the pivoting in the above-mentioned direction A, the rods 22 also move in rotation about the central longitudinal axis 11'.

These rods 22 then exert a pressure within the respective housings 31 of the male elements 15, while traveling within these housings 31, until reaching the proximal end 311 of these latter.

This movement causes the two male elements 15, guided in translation by the above-mentioned translation guiding means 24, to move closer together.

This movement leads to the moving apart of their nesting portions 15*a*, so as to be extracted from the annular groove 16 of the driving motor shaft 10 and to be retracted from the space of the blind housing 35.

This rotating actuator member 21 hence constitutes a particularly simple and effective solution, to control the translational displacement of the male elements 15 towards their inactive position.

The rotor 11 is then free in translation with respect to the motor shaft 10, upwards and in a pulling direction E (FIG. 13) that is opposite to the above-mentioned assembly direction T.

Figure 10:
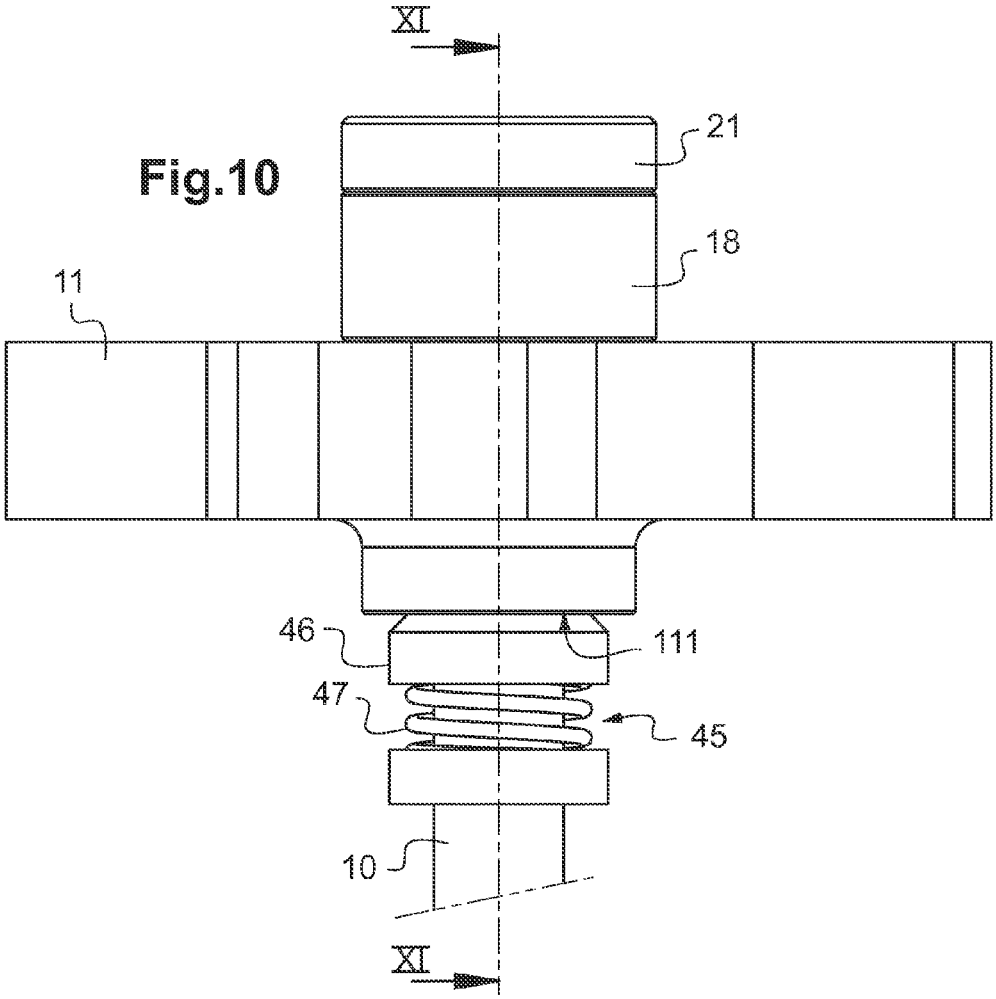
FIG. 10 shows, in a side view, the rotor suitably assembled to the driving motor shaft.

This extraction operation of the rotor 11 is also facilitated thanks to the pressure exerted upwards by the continuous ring 46, due to the release of the previously compressed spring member 47 (FIG. 10).

The releasing of the rotating actuator member 21 allows an automatic return of the male elements 15 to the active position, under the effect of the above-mentioned return means 25 that are released.

The same rotor 11, or another adapted rotor, can then be added on the free motor shaft 10.

Generally, the operations of assembly and of separation of the rotor 11, with respect to the motor shaft 10, are then particularly simple and ergonomic.

In particular, the deactivation of the translation locking means is performed by a simple rotational movement of the rotating actuator member 21, which is in practice simpler, intuitive and ergonomic; this single handling also allows to better inform the user about the effective locking of the rotor. Moreover, this structure according to the invention avoids the aerodynamic noise and offers easy-to-clean surfaces.

The invention claimed is:

1. A laboratory centrifuge comprising:

two rotating parts, one of the rotating parts being a driving motor shaft and the other of the rotating parts being a rotor, each of the rotating parts having a central longitudinal axis and being provided with complementary assembly devices configured to removably mount said rotor on a free end of said driving motor shaft, coaxially with respect to each other, the assembly devices comprising a locking system for locking in translation of said rotor on said driving motor shaft, the translation locking system comprising at least one female element equipping one of said rotating parts, and at least one complementary male element equipping the other of said rotating parts, the male element being mobile between an active position in which the male element cooperates with said female element to ensure said locking in translation, and an inactive position in which the male element is separated from said female element, to result in the translation of said rotor with respect to said driving motor shaft, the male element being mobile in translation for its operation between the active position and the inactive position, the male element being associated with an active-position return device, and an inactive-position operating device for an operation of the male element to the inactive position, said inactive-position operating device comprising a rotating actuator member that is carried by one of said rotating parts and that is pivotally mobile about itself according to an axis of rotation extending coaxially to the central longitudinal axis of said associated rotating part, the rotating actuator member cooperating with said male element to ensure, by a rotational operation of said rotating actuator member about its axis of rotation, the displacement of said associated male element from said active position to said inactive position, the rotational operation of the rotating actuator member being transformed into a translational movement of the male element between the inactive position and the active position, the releasing of the rotating actuator member allowing an automatic return of the male element to the active position, under the effect of the active-position return device that is released.

2. The laboratory centrifuge according to claim 1, wherein the rotating actuator member of the operating system is carried by the rotor.

3. The laboratory centrifuge according to claim 2, wherein the rotating actuator member protrudes at an upper end of said rotor, opposite an access to a bowl of the centrifuge configured to contain the rotating parts.

4. The laboratory centrifuge according to claim 2, wherein the male element is carried by the rotor and the female element is arranged on the driving motor shaft.

5. The laboratory centrifuge according to claim 2, wherein the driving motor shaft is configured to be driven into rotation in a given direction of rotation, and the rotating actuator member is operated in said given direction of rotation for the displacement of said male element from said active position to said inactive position.

6. The laboratory centrifuge according to claim 1, wherein the male element is carried by the rotor and in that the female element is arranged on the driving motor shaft.

7. The laboratory centrifuge according to claim 1, wherein the driving motor shaft is configured to be driven into rotation in a given direction of rotation, and the rotating actuator member is operated in said given direction of rotation for the displacement of said male element from said active position to said inactive position.

8. The laboratory centrifuge according to claim 1, wherein the rotating actuator member includes a protruding rod, extending parallel to and remote from the axis of rotation of said rotating actuator member, and the male element includes a housing within which extends said protruding rod, the housing is disposed so that, during the rotational operation of said rotating actuator member, said moving rod causes the displacement in translation of said associated male element.

9. The laboratory centrifuge according to claim 8, wherein the male element is disposed inside a continuous tubular envelope that is provided with a fixation device configured to fix to the associated rotating part, which carries the rotating actuator member and which cooperates with said male element for its guiding in translation.

10. The laboratory centrifuge according to claim 8, wherein the translation locking system comprises two male elements that are arranged symmetrically with respect to the central longitudinal axis of the associated rotating part, each male element including an elongated cylindrical portion that is associated with an active-position return member and is inserted into a complementary housing arranged in the other male element, to form a translation guiding system and the active-position return device.

11. The laboratory centrifuge according to claim 1, wherein the male element is disposed inside a continuous tubular envelope that is provided with a fixation device configured to fix to the associated rotating part, which carries the rotating actuator member and which cooperates with said male element for its guiding in translation.

12. The laboratory centrifuge according to claim 11, wherein the translation locking system comprises two male elements that are arranged symmetrically with respect to the central longitudinal axis of the associated rotating part, each male element including an elongated cylindrical portion that is associated with an active-position return member and is inserted into a complementary housing arranged in the other male element, to form a translation guiding system and the active position return device.

13. The laboratory centrifuge according to claim 1, wherein the translation locking system comprises two male elements that are arranged symmetrically with respect to the central longitudinal axis of the associated rotating part, each male element including an elongated cylindrical portion that is associated with an active-position return member and is inserted into a complementary housing arranged in the other male element, to form a translation guiding system and the active-position return device.

14. A rotor configured to equip the laboratory centrifuge according to claim 1, carrying the rotating actuator member.

* * * * *